US005515634A

United States Patent [19]

Kong

[11] Patent Number: 5,515,634

[45] Date of Patent: May 14, 1996

[54] HOUSEHOLD SAFETY LOCK AND GUN LOCK GUARD

[76] Inventor: Yu W. Kong, 3375 S. Rainbow Blvd., Las Vegas, Nev. 89103

[21] Appl. No.: 243,720

[22] Filed: May 17, 1994

[51] Int. Cl.[6] ..... F41A 17/46

[52] U.S. Cl. ..... 42/70.11; 42/70.06; 42/70.07; 215/220; 215/276; 70/164; 70/171

[58] Field of Search ..... 42/70.11, 70.07, 42/70.06; 215/207, 211, 220, 276, 302; 70/164, 167, 171, 158, 160

[56] References Cited

U.S. PATENT DOCUMENTS

| | | | |
|---|---|---|---|
| 1,534,607 | 4/1925 | Oberdorfer | 70/171 |
| 1,689,979 | 10/1928 | Tate et al. | 70/166 |
| 1,778,502 | 10/1930 | Levey | 70/164 |
| 3,526,332 | 9/1970 | Adelberger | 215/207 |
| 3,912,411 | 10/1975 | Moffat | 403/259 |
| 5,106,251 | 4/1992 | Steinbach | 292/251 |

OTHER PUBLICATIONS

The Random House College Dictionary, 1980, p 387.

*Primary Examiner*—Stephen M. Johnson
*Attorney, Agent, or Firm*—Quirk & Tratos

[57] ABSTRACT

Household Safety Lock device includes two different screw thread connecting parts separately connecting to a regular lock and a household ware. They can join together or divide separate easily with a bar. So every dangerous household ware is easily locked for protecting children.

Gun Lock Guard device includes regular trigger lock section and permanent lock section. The device will lock or unlock the trigger temporarily whenever using the real key. But it will lock the trigger permanent deadly whenever trying unlock the trigger with counterfeit key or destroying the lock. This device increases safety for guns.

4 Claims, 12 Drawing Sheets

HOUSEHOLD SAFETY LOCK AND GUN LOCK GUARD

BACKGROUND OF THE INVENTION

1. Field of the Invention

This invention relates to two devices which are separately additional to the regular locks. One of them may lock the dangerous household wares to protecting children. The other one may improve the safety of trigger lock on guns.

2. Description of the Prior Art

In recent years the dangerous household wares like lighters, knives, guns, electric ovens, gas stoves, bottles containing pills, poisons, and harmful materials, etc. are always the threats to children. It is impossible to avoid children touching them absolutely. Many devices were designed in an attempt to solve this problem. U.S. Pat. Nos. 4,496,309 and 4,509,916 disclose a child guard device in lighters. Although children can not use it in the beginning, they are curious to try it again and again and pay attention to the adults using it. Finally some older children will find out how to use it thus this device becomes inefficient to them. Another simply and directly way is locking the dangerous household wares separately. It is an effect way to protecting children indeed. Now there are many kinds trigger locks to lock guns. But there is not a simple uniform method to lock every dangerous household ware. Most of them can not be locked or can hardly be locked. The instant invention solves this problem. Household Safety Lock is easily using, fixing or transfering to lock every dangerous household ware.

Gun is a different item in safety. Guns are not only avoided using by children but also by the bad fellows. We are extremely concerned over that the locked guns are lost,stolen or robbed by the bad fellows, they can be unlocked for criminal using. Now all the trigger locks to guns are easily unlocked by the locksmiths, they are easily destroyed and removed by electric drills and saws. Gun Lock Guard device of the instant invention solve this problem. When the locksmith pushing counterfeit key into the keyhole to try unlock, or destroying the lock of gun with tools, Gun Lock Guard device will lock the trigger permanently. Nobody can unlock the trigger again even the owner use the real key to do it. This deadlock can not be relaxed except the gun is destroyed partially. Thus the gun is almost useless.

SUMMARY OF THE INVENTION

According to the present invention, Household Safety Lock includes a regular lock with a screw thread connecting part, and a screw thread connecting part to the household ware. They are easily joined together and fixed with a bar. They are also divided easily when pulling out the bar. We join them or divide them without any tool. Gun Lock Guard is an additional device to the trigger lock which includes a large holed screw, a rod controlled by the lockkey moving in or out to the screw hole to lock or unlock the trigger, two teethed bars which are hanged by two strings look like an opening crocodile's mouth, the two strings are fixing into the lock by two pieces of springs. When the springs relax the pressure on the strings, the teethed bars will bite the rod permanently so that the trigger will be locked anywise.

BRIEF DESCRIPTION OF THE INVENTION

The drawings appended hereto are as follows.

Figure 6:
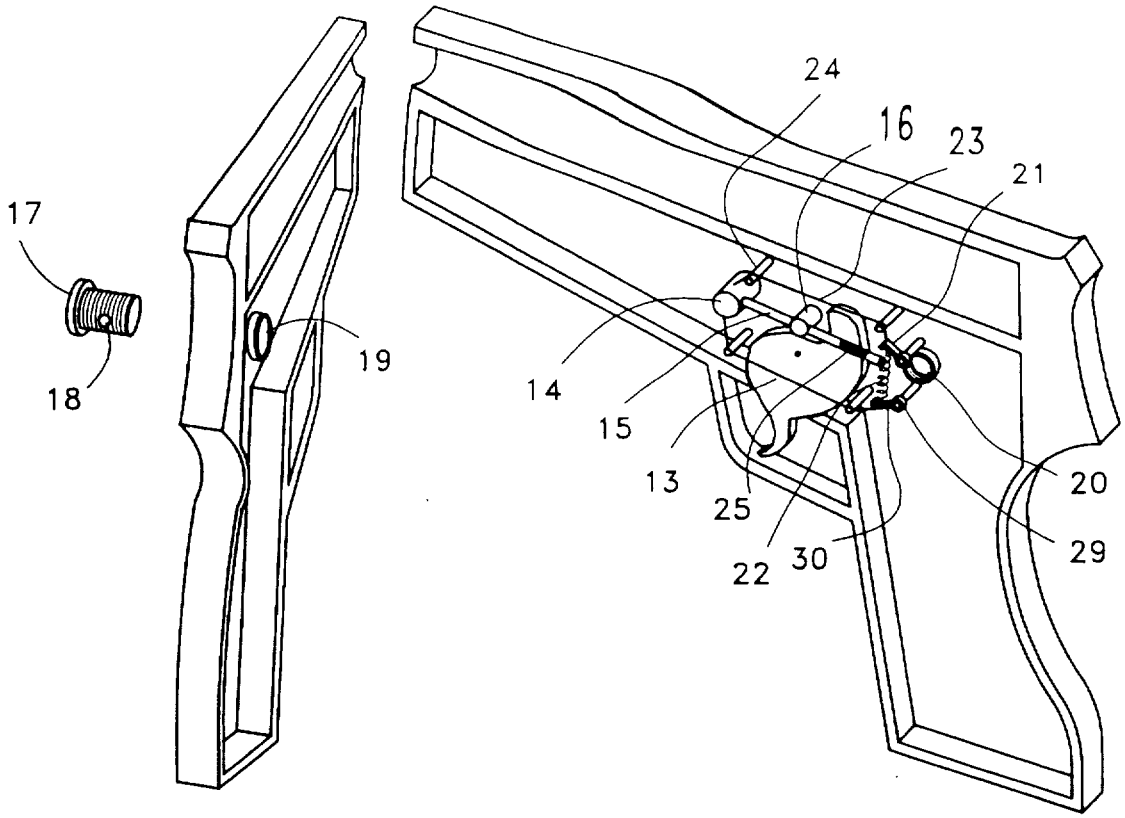
FIG. 6 is a perspective view of a hand gun in two pieces, showing the Gun Lock Guard device.
Figure 7A:
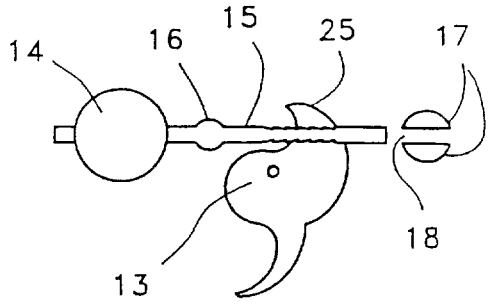
FIG.7A, 7B and FIG. 7H to 7J are schemata and perspective views cut away partially, showing the regular trigger lock section shown in FIG. 6.
Figure 7B:
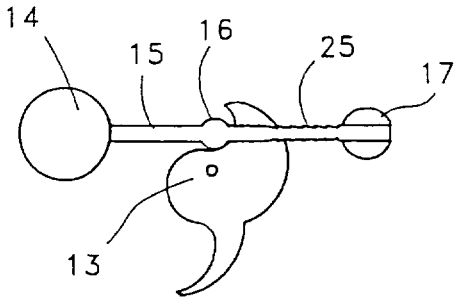
Figure 7C:
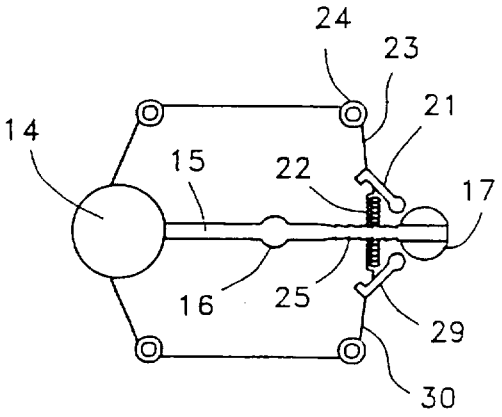
Figure 7D:
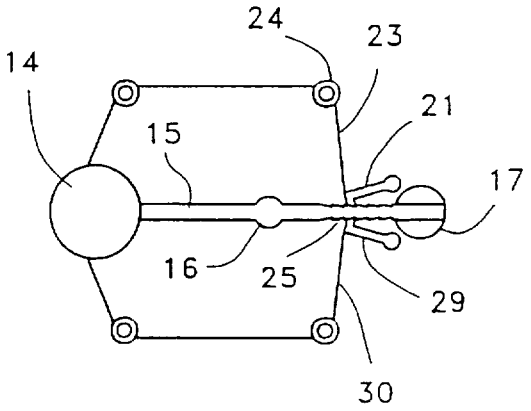
Figure 7E:
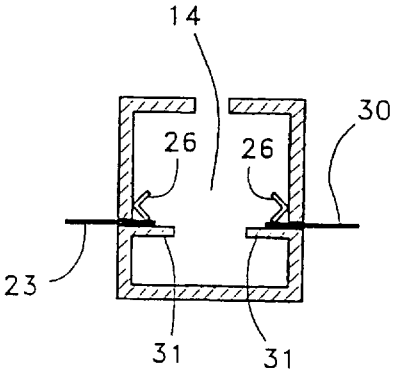
Figure 7F:
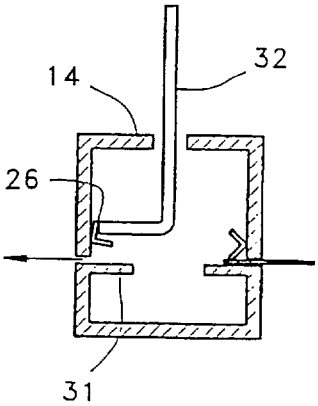
Figure 7G:
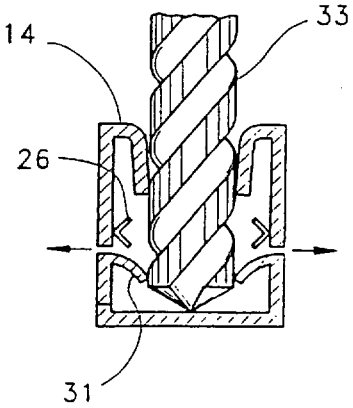
Figure 7H:
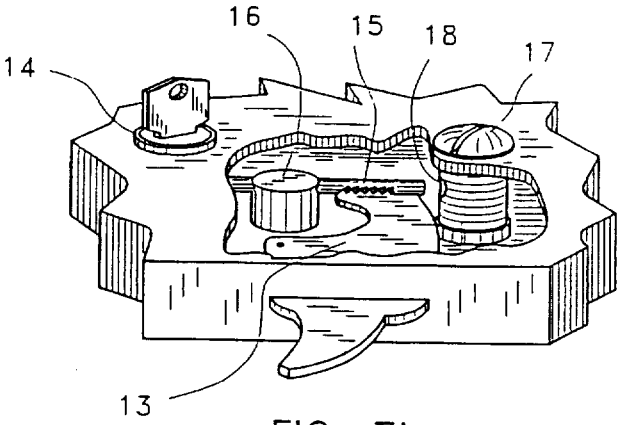
Figure 7J:
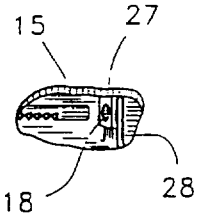
Figure 7I:
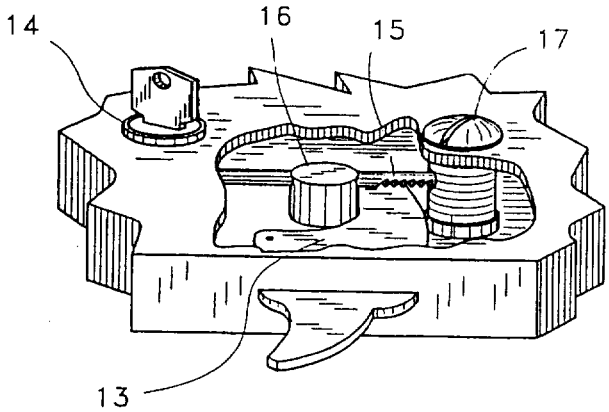
Figure 7K:
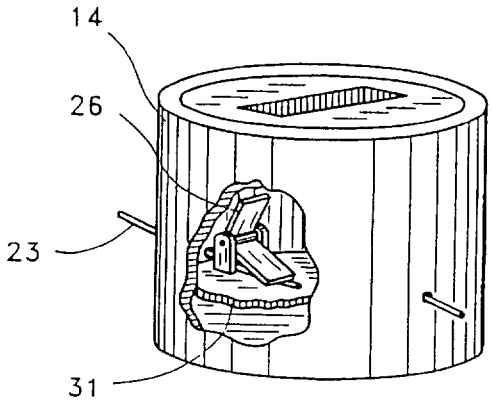
Figure 7L:
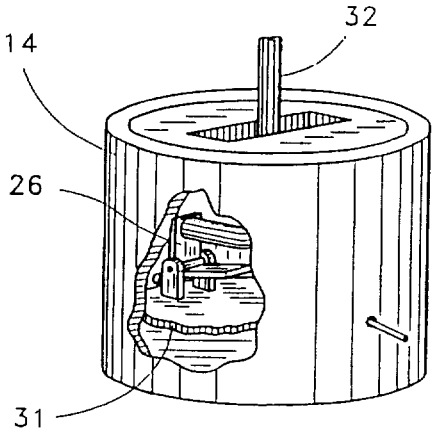

FIG. 7C and 7D schematically show the permanent lock section shown in FIG. 6;

FIG. 7E to 7G and FIG. 7K, 7L are vertical cross-sectional views and perspective views cut away partially, showing the parts of the Gun Lock Guard device working into the regular lock.

DETAILED DESCRIPTION OF THE PREFERRED EMBODIMENTS

Figure 1A:
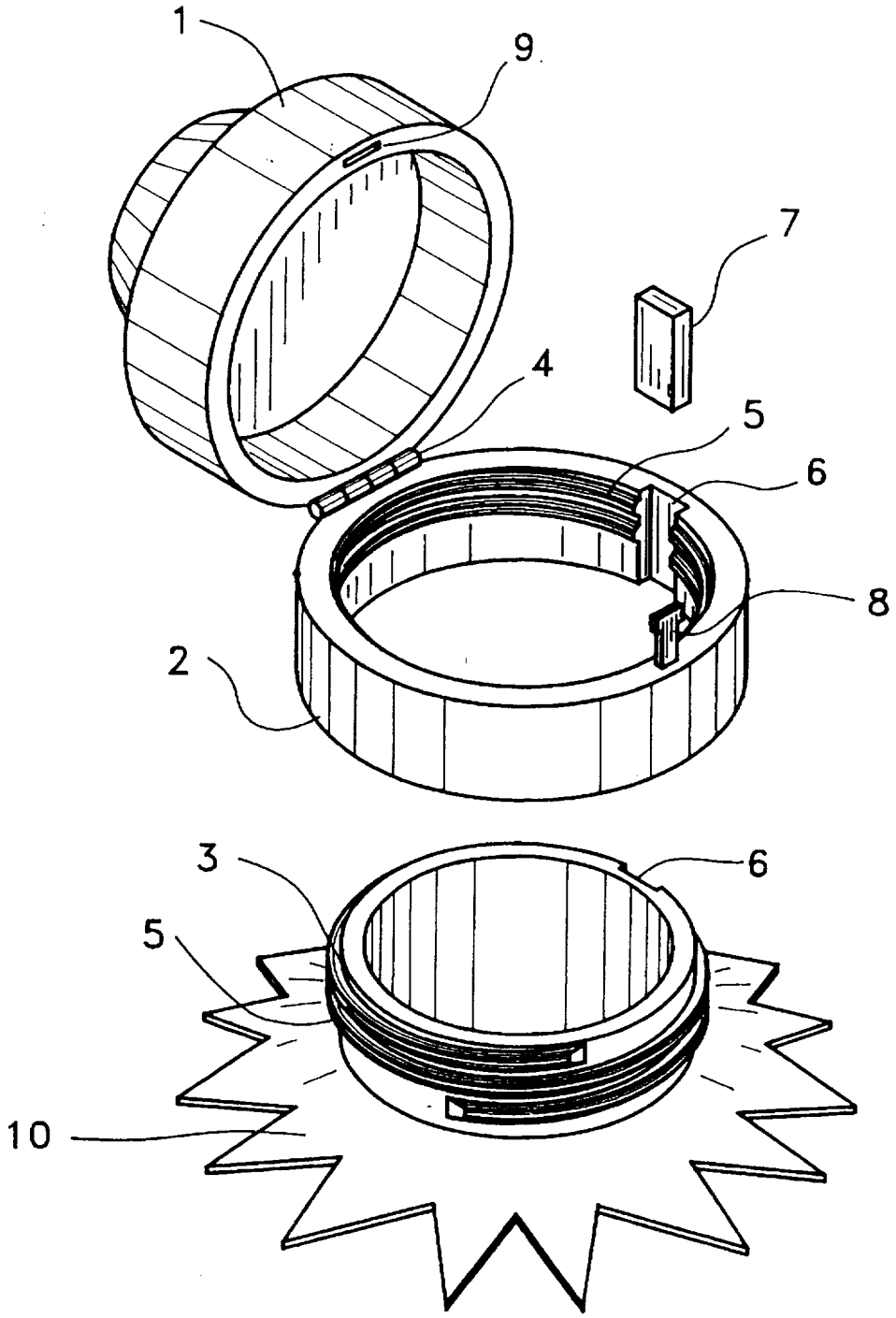
FIG. 1A and 1B are perspective views in different directions of the Household Safety Lock and the screw thread connecting part to the household ware.
Figure 1B:
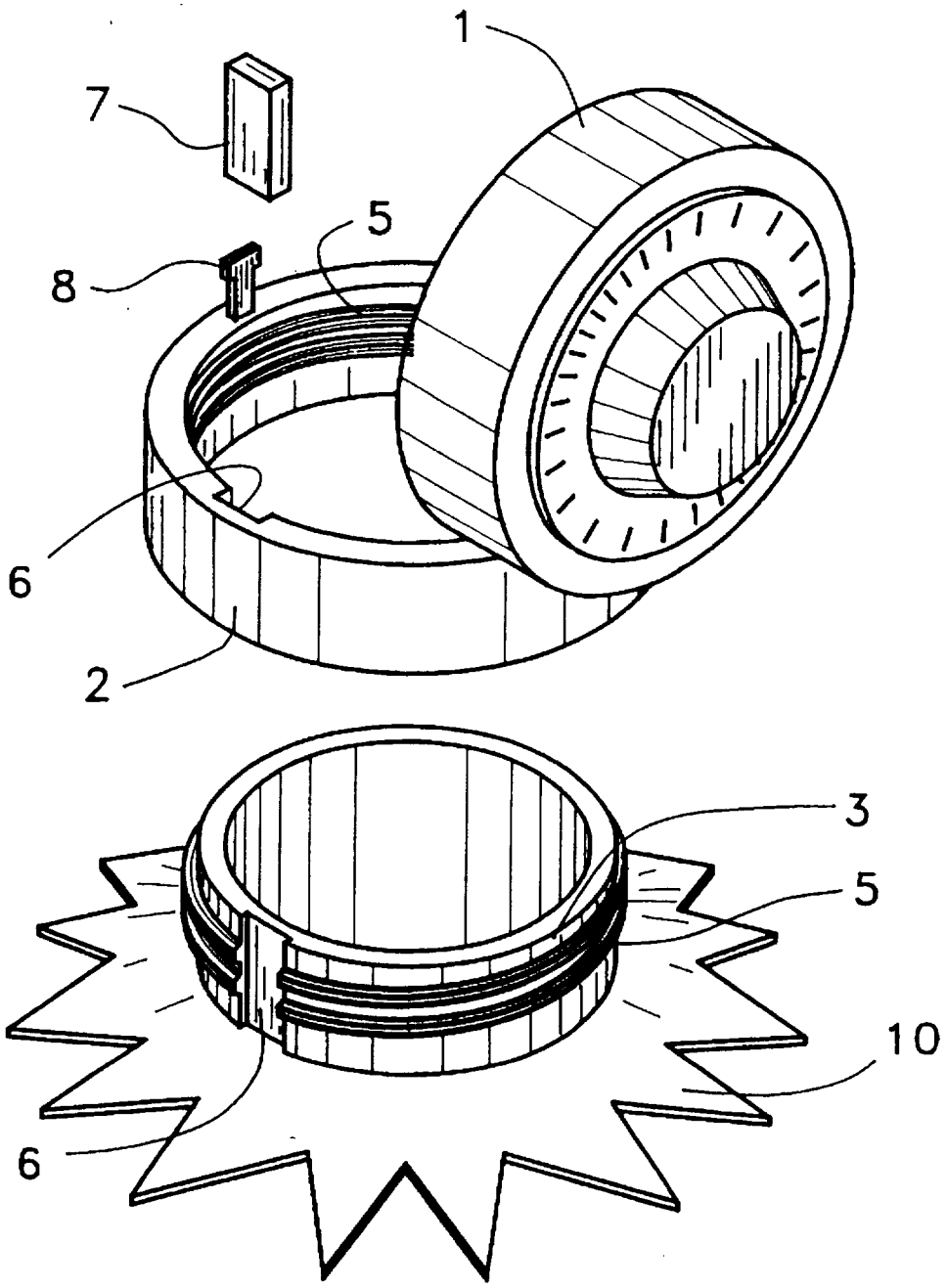
Figure 1C:
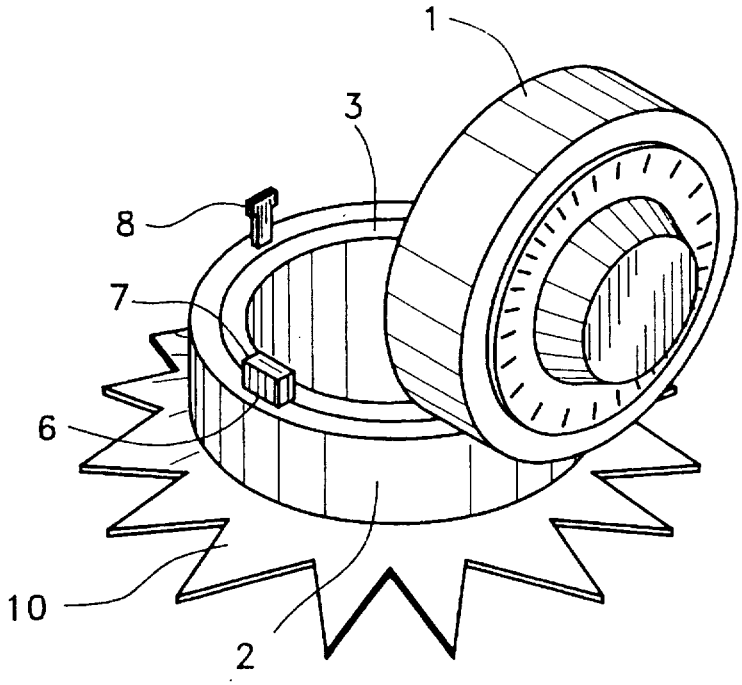
FIG. 1C to 1F are perspective views and vertical cross-sectional views separately showing the Household Safety Lock fixing to the household ware and locking.
Figure 1D:
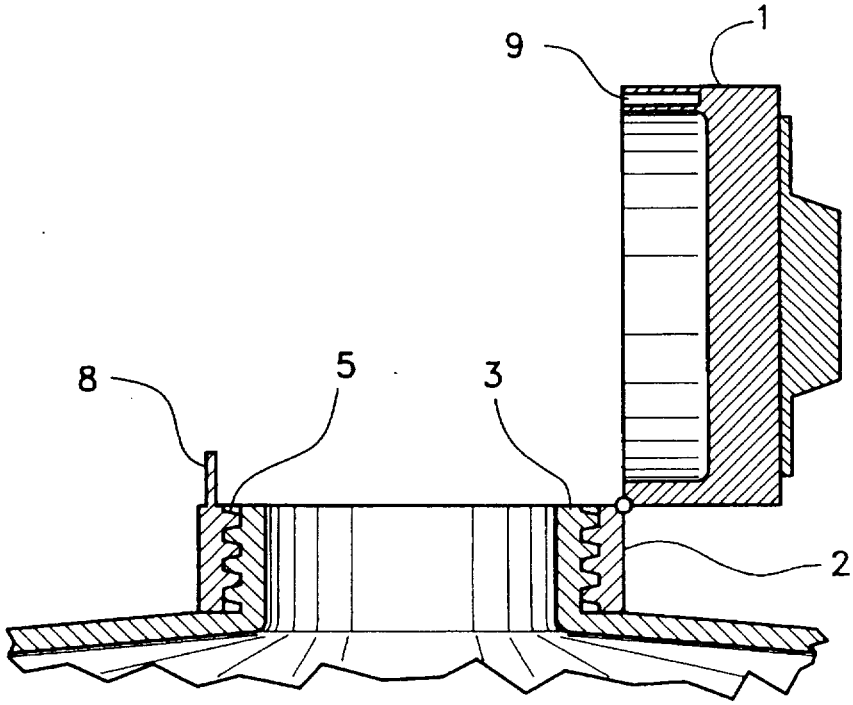
Figure 1E:
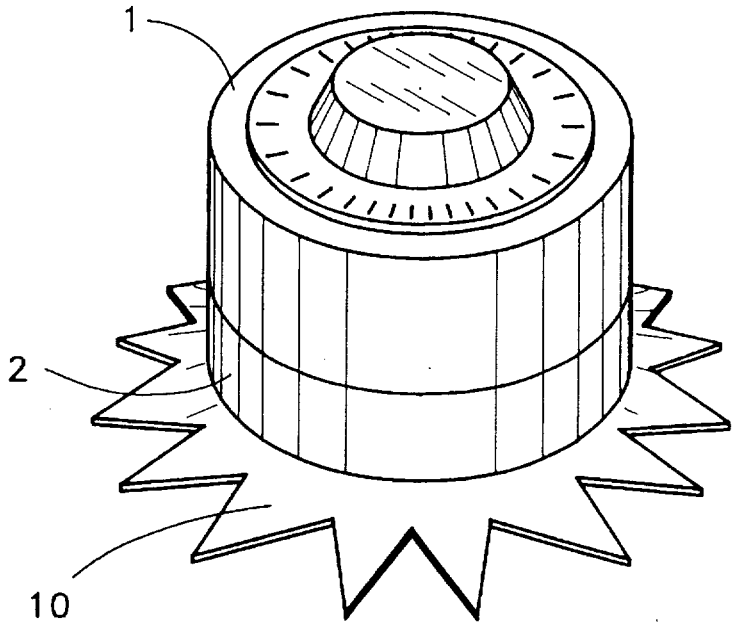
Figure 1F:
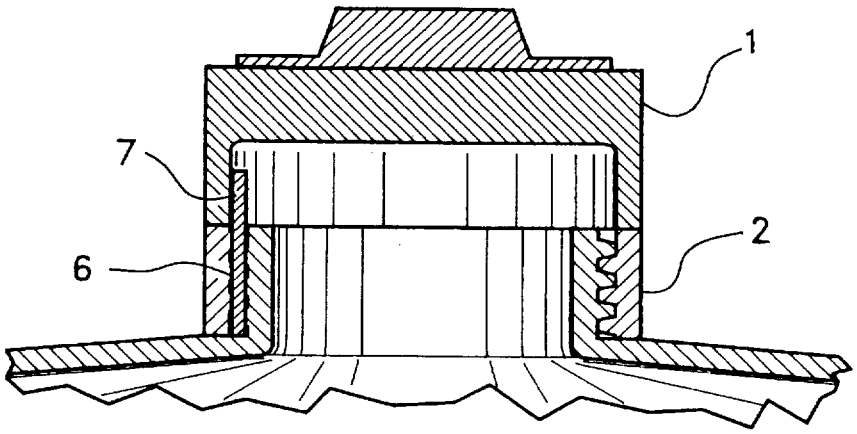

Preferred embodiments of the present invention is described as followings:

FIG. 1A and 1B are perspective views in different directions of the Household Safety Lock and the screw thread connecting part to the household ware. The Household Safety Lock includes an any kind regular lock 1, a connecting part 2 having the shape of a hollow, open ended cylinder and a bar 7. The interior surface of connecting part 2 has a longitudinal slot 6 therein. Additionally, the interior surface of connecting part 2 is internally threaded with threads 5. Slot 6 forms a discontinuity in threads 5. Connecting part 2 connects to lock 1 with hinge 4. Locking rod 8 on connecting part 2 can be pushed into the hole 9 on lock 1, thus lock 1 can lock the connecting part 2 with rod 8. There is a connecting part 3 on the household ware 10. (Ware 10 is partially cut away shown in figure) There are the same screw threads 5 and slot 6 on the exterior face of the connecting part 3. FIG. 1C to 1F are perspective views and vertical cross-sectional views separately showing the Household Safety Lock fixing to the household ware and locking. Turning the both screw threads 5 to put part 3 into part 2, finally let the both slots 6 turning onto the same point, then push bar 7 into slots 6 thus the Household Safety Lock 1 & 2 is fixing to the household ware 10. We can lock or unlock it easily. We can remove it easily when pulling out the bar 7.

Figure 2A:
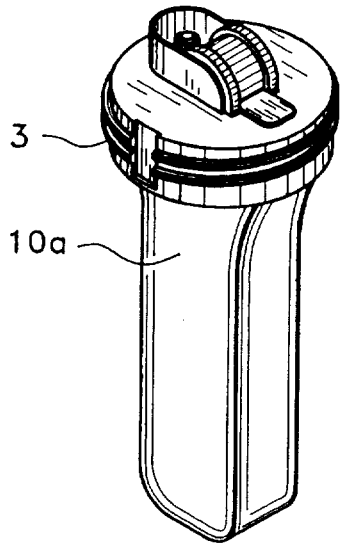
FIG. 2A to 2C are perspective views showing the Household Safety Lock using to lighters.
Figure 2B:
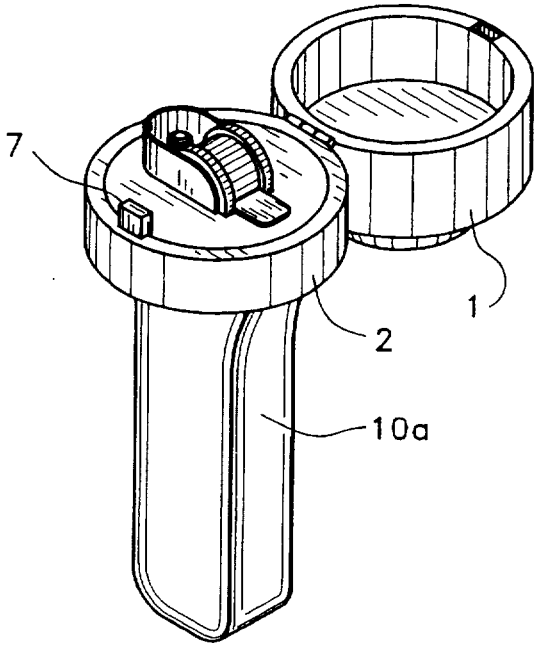
Figure 2C:
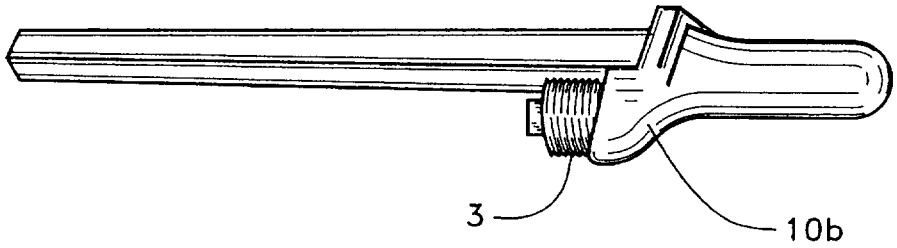

FIG. 2A to 2C are perspective views showing the Household Safety Lock using to lighters. The figures show the connecting parts 3 to two different lighters 10, one for cigarette lighting, one for stove firing. The Household Safety Lock 1 & 2 are easily fixed to lighters 10 and locked. They are also transfered to the new one while the fuel is over.

Figure 3A:
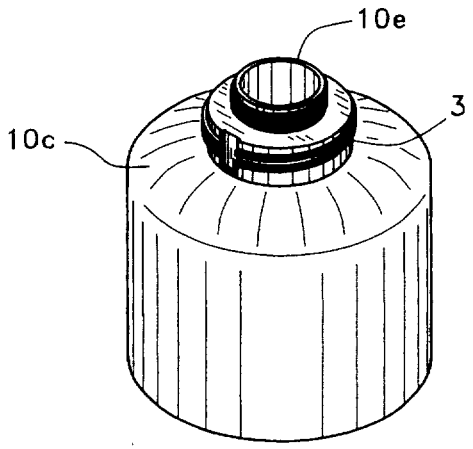
FIG. 3A and 3B are perspective views showing the Household Safety Lock using to the bottle.
Figure 3B:
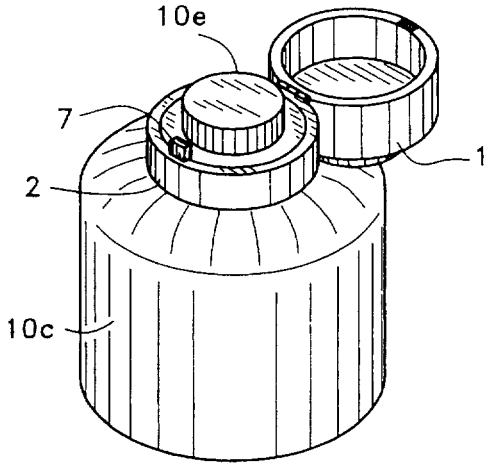

FIG. 3A and 3B are perspective views showing the Household Safety Lock using to the bottle. The connecting part 3 locates under the cover of the bottle 10, thus lock 1 & 2 can lock the covered bottle 10.

Figure 4A:
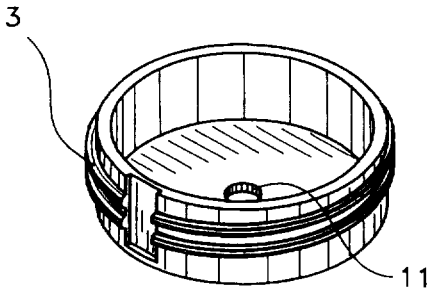
FIG. 4A and 4B are perspective views showing the Household Safety Lock using to the switch button.
Figure 4B:
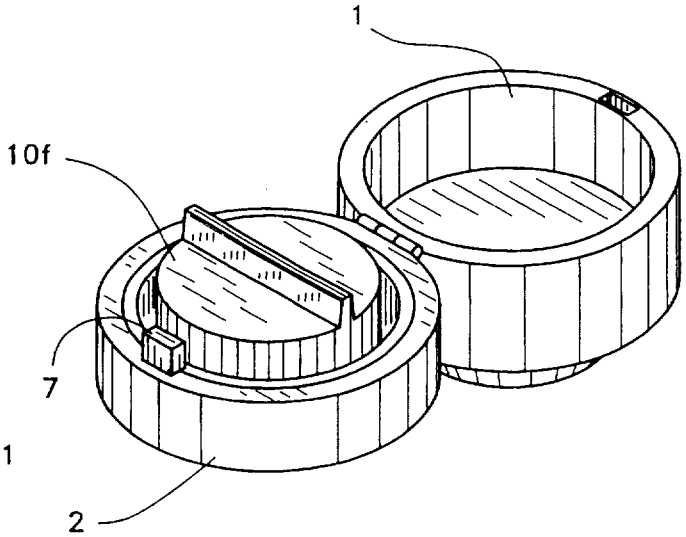

FIG. 4A and 4B are perspective views showing the Household Safety Lock using to the switch button. There is a hole 11 at the bottom of the connecting part 3 for fixing it under the switch button 10. Pull the button 10 off the switch rod, push the hole 11 crossing the switch rod thus the connecting part 3 is fixed to the switch rod, push the button 10 back to the switch rod and fix it, so the connecting part 3 is fixing to the switch button 10 ready for lock 1 & 2 using.

Figure 5A:
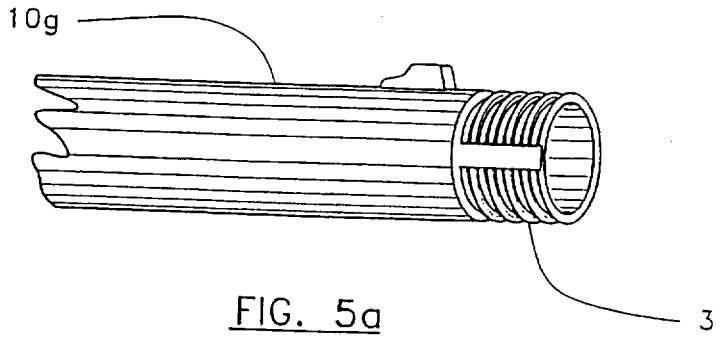
FIG. 5A to 5F are perspective views showing the Household Safety Lock using to guns.
Figure 5B:
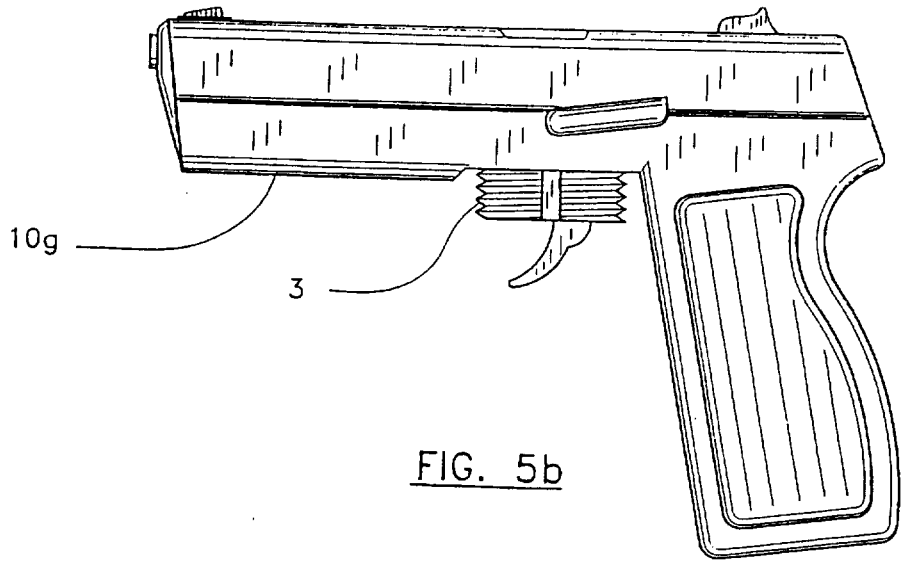
Figure 5C:
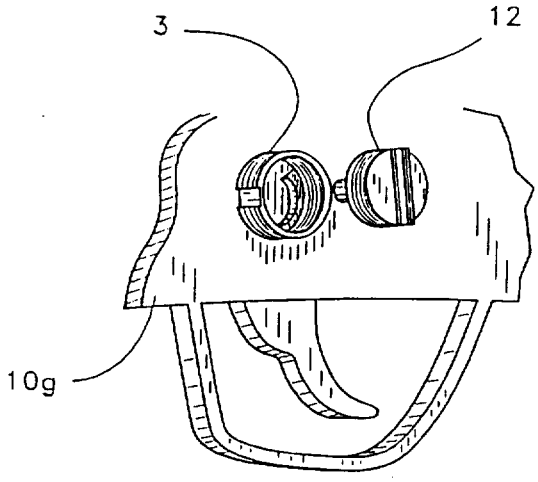
Figure 5D:
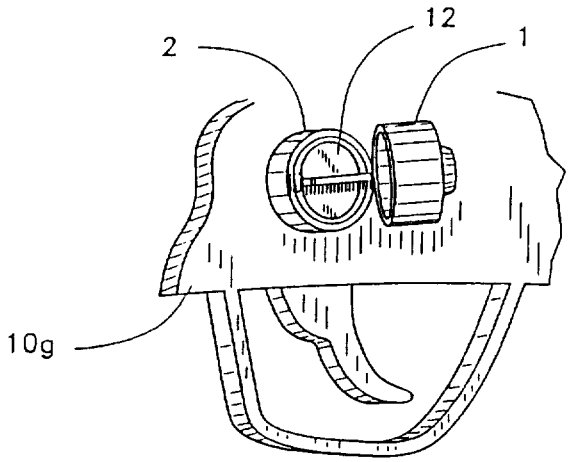
Figure 5E:
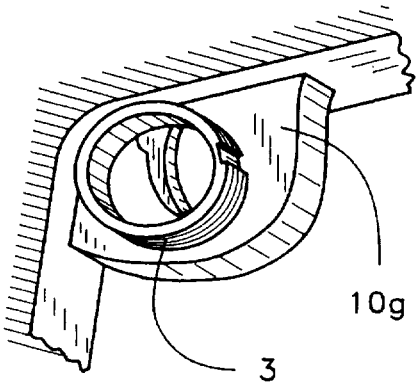
Figure 5F:
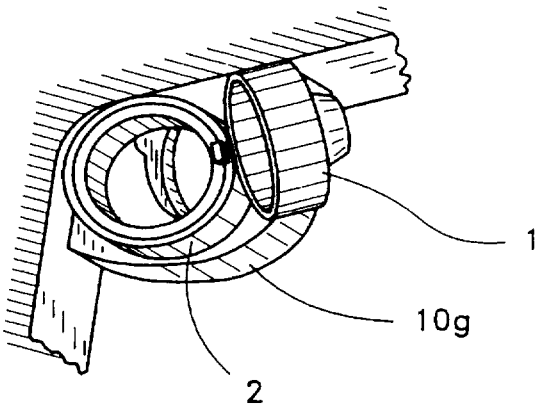

FIG. 5A to 5F are perspective views showing the Household Safety Lock using to guns. FIG. 5A shows the connecting part 3 locating at the end of the gun barrel. It is only for BB gun or spray gun using. FIG. 5B to 5F show the connecting parts 3 locating on three different positions of guns to lock the triggers by the locks 1 & 2. The device of FIG. 5C and 5D must be increased a lock bar 12 to lock the trigger. Besides the connecting part 3 can be attached to every dangerous household ware not only shown as above. The Household Safety Lock 1 & 2 can lock every item which is attaching the connecting part 3. If there are a lot items needed to lock in a house, for easily using and remembering, we can choose the same key to unlock all the key-lock 1 & 2 and use the same code to unlock all the digital code-lock 1 & 2.

FIG. 6 is a perspective view of a hand gun cutting in two pieces, showing the Gun Lock Guard device. The Gun Lock Guard device divides to a regular trigger lock section and a permanent lock section. The regular trigger lock section includes a regular lock 14, a locking rod 15 and a large screw 17. The regular lock 14 should be a key-lock or digital code-lock. There is a trigger lock bar 16 on the rod 15 to lock the trigger 13. There are some cogs 25 on one side of the rod 15 for permanent lock using. The other side of rod 15 is crossing lock 14 and controlling by lock 14 to only moving forward or backward. On the screw 17 there is a hole 18 which rod 15 can be crossing through. When combining two pieces of the gun, the screw 17 must cross the screw hole 19 to fixing into the screw hole 20. The last position of the screw 17 must be turning the hole 18 towards to the end of rod 15. The permanent lock section includes two bars 21 & 29, a spring 22, two strings 23 & 30, two pieces of springs (not shown in figure) inside the lock 14. The bars 21 and 29 are connecting with the spring 22 that pulls them together. One end of the bar is fixed near the hole 20. The other ends of the bars 21 and 29 with some cog teeths are hanged separately by the strings 23 and 30, look like an opening crocodile's mouth. The strings 23 and 30 passing the pulleys 24 are fixing into the lock 14 by two springs.

FIG. 7A, 7B, 7H, 7I and 7J are schemata and perspective views cut away partially, showing the regular trigger lock section working. When we turn the key of lock 14 for locking, the rod 15 will move forward into the hole 18, at the same time the trigger lock bar 16 will forward to lock the trigger 13. The screw can not be removed away at this time. When we turn back the key for unlocking, the trigger lock bar 16 will move back to unlock the trigger 13, at the same time the rod 15 will move out off the hole 18, thus the screw 17 can be removed away for gun repairing or cleaning. We can use two bars 27 & 28 with the same hole 18, separately fixing on two pieces of gun instead of the screw 17, shown in FIG. 7J.

FIG. 7C and 7D schematically show the permanent lock section working. When lock 14 is locking and rod 15 is moving into the screw 17, if the springs inside lock 14 relax connection to the strings 23 and 30, the spring 22 will pull the bars 21 and 29 to bite the rod 15 deadly. The ends of the strings 23 and 30 will be pulled out and far away to lock 14.

FIG. 7E, 7F, 7G, 7K, and 7L are vertical cross-sectional views and perspective views cut away partially of the lock 14, showing how the parts of the permanent lock section inside lock 14 working. There are two pieces of plates 31 inside the lock 14, and two pieces of springs 26 locate above plates 31 to press them. The strings 23 and 30 are separately pressed between, the plates 31 and the springs 26. If the counterfeit key 32 push into the keyhole to try unlock, it will mistouch one or both springs 26, the string 23 or 30 or both will be pulled out of the lock 14 when the pressure is relaxing. If a drill 33 or other tools destroy the lock 14, the plates 31 will be destroyed too, the strings 23 and 30 will be pulled out of the lock 14

As has been described above, according to the present invention, every dangerous household ware can be easily locked and unlocked, or we can easily transfer the lock from one item to another. So the problems due to protecting children can be solved. Otherwise, the device attaching to the trigger lock is not only avoiding children to use the gun, but also avoiding the bad fellows to use it for criminal action when the gun is lost. To unlock the trigger lock for them is more difficult than to get another one. It almost guarantees the guns are only for owner using. So the problems due to increasing gun safety can be solved. My invention is very novel.

Having thus described my invention, I claim:

1. A lock device comprising, a regular lock connected to an open ended, hollow, cylindrical connecting part having an inner threaded surface and an outer surface and a slot extending along said inner surface of said part and parallel to an axis of said threads, said slot crossing the threads of said part, a household ware with threads thereon and a slot crossing the threads of said ware, and a fixing bar for engagement with said slots when both said part and said ware engage one another and said slots are aligned.

2. The lock device according to claim 1, wherein said regular lock is hingedly connected to said connecting part.

3. The lock device according to claim 1, where said household ware comprises a bottle having said threads and ditch thereon.

4. A locking device comprising: a connecting part comprising a generally circular ring having an inner surface, outer surface, and generally open interior, said part having a number of threads on said inner surface for engagement with a set of threads on an item to be locked, said part also including a slot extending along said inner surface through said threads on said inner surface, locking means connected to said connecting part, said locking means movable between first locked position in which it obstructs access to said open interior of said connecting part and a second unlocked position in which said interior portion of said connecting part is accessible; and a pin for engagement with said slot in said connecting part and a slot on said item to be locked, said pin preventing movement of said connecting part with respect to said item.

* * * * *